US006196422B1

(12) United States Patent
Tuyls et al.

(10) Patent No.: US 6,196,422 B1
(45) Date of Patent: Mar. 6, 2001

(54) HOT BEVERAGE DISPENSING SYSTEM

(75) Inventors: James M. Tuyls, Vacaville; Charles E. Bennett, Sacramento, both of CA (US)

(73) Assignee: Automatic Bar Controls, Vacaville, CA (US)

( * ) Notice: Subject to any disclaimer, the term of this patent is extended or adjusted under 35 U.S.C. 154(b) by 0 days.

(21) Appl. No.: 09/415,948

(22) Filed: Oct. 8, 1999

Related U.S. Application Data

(60) Provisional application No. 60/103,753, filed on Oct. 9, 1998.

(51) Int. Cl.[7] ..... B67D 5/56

(52) U.S. Cl. ..... 222/129.1; 222/145.6; 222/146.2; 222/318

(58) Field of Search ..... 222/129.1, 145.6, 222/318, 146.2, 129.4

(56) References Cited

U.S. PATENT DOCUMENTS 3,790,028 * 2/1974 Garner, Jr. et al. ..... 222/129.4
4,458,829 * 7/1984 Greenfield, Jr. et al. ..... 222/146.2
5,114,045 * 5/1992 Herpe ..... 222/318

* cited by examiner

*Primary Examiner*—Philippe Derakshani
(74) *Attorney, Agent, or Firm*—Townsend and Townsend and Crew LLP

(57) ABSTRACT

This invention provides a system and a method of economically dispensing hot beverages at precise temperature ranges in a continuous manner suitable for large-scale high-volume usage. An on-demand heater is used to heat water to a preset temperature range. The hot water is circulated to a dispensing head and recirculated back to the heater by a recirculation pump to provide a continuous flow of hot water. A supply of beverage concentrate is flowed into the dispensing head by a peristaltic pump. Upon activation of a button, the hot water is flowed into a nozzle of the dispensing head to create a vortex-like flow. The beverage concentrate is injected into the vortex-like flow and mixed with the hot water to form the hot beverage which is dispensed from the dispensing head.

25 Claims, 5 Drawing Sheets

HOT BEVERAGE DISPENSING SYSTEM

CROSS-REFERENCES TO RELATED APPLICATIONS

This application is based on and claims priority from U.S. Provisional Application, Ser. No. 60/103,753, filed on Oct. 9, 1998, the entire disclosure of which is incorporated herein by reference.

BACKGROUND OF THE INVENTION

This invention relates generally to dispensing systems and, more particularly to a system for dispensing hot beverages or the like. Hot beverage dispensing systems are commonly used in homes, offices, and restaurants. Heretofore, when it was desired to provide hot beverages, the beverages were heated or brewed and kept hot in a heated container. Conventional systems for producing hot beverages were expensive, labor-intensive, and difficult to maintain, and could not continuously provide fresh beverages. Moreover, separate containers were needed for different beverages, and they had to be regularly removed and cleaned. Thus, there is a need for a more efficient and inexpensive system for dispensing hot beverages.

SUMMARY OF THE INVENTION

The present invention relates to an improved dispensing system for economically delivering hot beverages. It is specially adapted to dispense hot beverages at precise temperature ranges in a continuous manner suitable for large-scale high-volume usage. The invention provides for dispensing hot beverages continuously at a dispensing head and efficiently by utilizing a heater that supplies hot water on demand to meet the rate of delivery of the beverage and recirculating continuously the hot water between the dispensing head and the heater. The continuous recirculation ensures that there are no regions of cooler water up to the dispensing head. A peristaltic pump directs a continuous supply of beverage concentrate to the dispensing head for mixing with the hot water while preventing sticking, drying, or gumming of the concentrate. The concentrate can be brixed to desired ratios for very economical delivery of hot beverages. The system is especially suitable for point-of-use applications.

In accordance with an aspect of the invention, a system for dispensing hot beverages comprises a water heater for producing hot water and a water pump coupled downstream of the water heater. A dispensing device is coupled downstream of the water pump. A recirculation line is coupled between the dispensing device and the water heater. A beverage concentrate pump is coupled between a beverage concentrate source and the dispensing device. The water heater is typically an on-demand, tankless water heater.

In some embodiments, the system includes a plurality of sources of beverage concentrates and corresponding beverage concentrate pumps coupled between the beverage concentrate sources and the dispensing device.

In a specific embodiment, the dispensing device includes a plurality of dispensing heads each coupled with one of the plurality of beverage concentrate pumps for receiving beverage concentrate from one of the plurality of beverage concentrate sources.

In other embodiments, the dispensing device includes a dispensing head coupled with thc beverage concentrate pumps via a plurality of beverage concentrate lines, and a control device operable for selectively activating the beverage concentrate pumps for pumping the beverage concentrates to the dispensing head. The dispensing head includes a plurality of valves each coupled with a corresponding beverage concentrate line. The valves are operable to open selectively to allow beverage concentrate to flow from the activated beverage concentrate pump through the corresponding beverage concentrate line out of the corresponding valve. The dispensing head further includes a water valve coupled with the recirculation line. The water valve is operable to open selectively in a mixing mode for mixing with the beverage concentrate flowed from the activated beverage concentrate pump to the dispensing head, and in a nonmixing mode for flowing water from the recirculation line out through the dispensing head.

In one embodiment, the dispensing device includes a valve, a switch operable to control opening and closing of the valve, and a portion control unit operable to activate the switch to open the valve for a selected period of time for dispensing. The portion control feature can be turned off at any time allowing override of continuous manual operation. The system can be switched at anytime between the two modes of operation.

In accordance with another aspect of the invention, a system for dispensing hot beverages comprises means for heating a fluid and a fluid pump coupled downstream of the heating means. A dispensing device is coupled downstream of the fluid pump. A recirculation line is coupled between the dispensing device and the heating means. The system further comprises means for supplying at least one source of beverage concentrate to the dispensing device.

Another aspect of the invention is a method of dispensing a hot beverage from a dispensing device upon activation of a switch. The method comprises the step of heating water substantially to a preset temperature. The heated water is flowed into the dispensing device upon activation of the switch to form a vortex-like flow in the dispensing device. A beverage concentrate is flowed into the vortex-like flow of the heated water to mix the beverage concentrate with the heated water in the dispensing device to form the hot beverage and discharge the hot beverage out of the dispensing device.

It is a particular object of the present invention to provide an improved system for economically dispensing hot beverages or the like which system can provide hot beverages in a continuous manner suitable for large-scale high-volume usage and is inexpensive and easy to maintain and clean. Other objects and advantages of the present invention will be apparent from the following detailed description read in view of the accompanying drawings which are made a part of this specification.

BRIEF DESCRIPTION OF THE DRAWINGS

The specific embodiments of this invention, illustrating all their features, will now be discussed in detail. These embodiments depict the novel and non-obvious dispensing system of this invention shown in the accompanying drawings, which are included for illustrative purposes only. These drawings include the following figures, with like numerals indicating like parts.

DESCRIPTION OF THE SPECIFIC EMBODIMENTS

Figure 1:
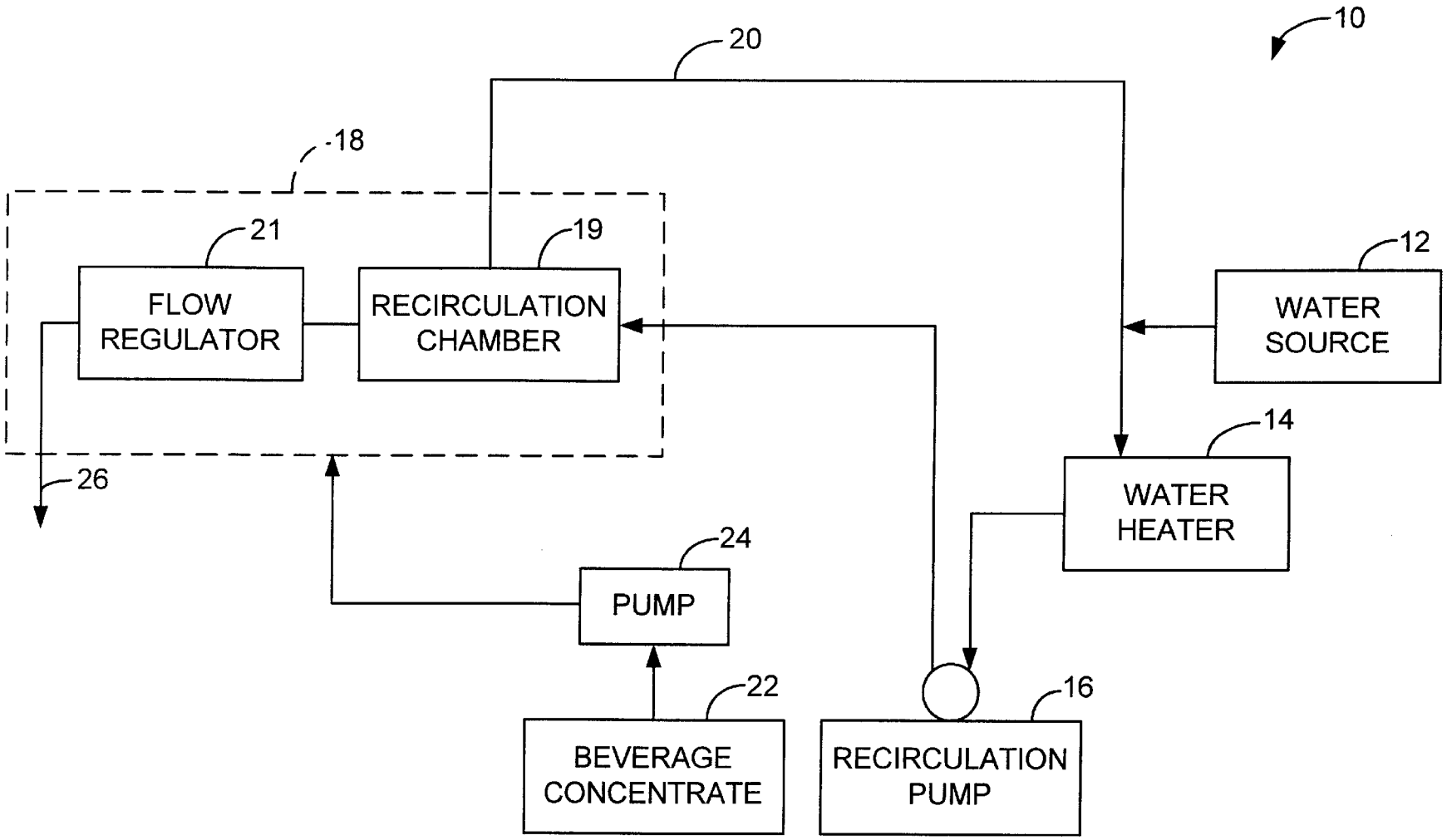
FIG. 1 is a block diagram schematically illustrating a dispensing system in accordance with an embodiment of the present invention.

Referring to the block diagram of the dispensing system 10 of FIG. 1, a water source 12 is connected to an input of a water heater 14 to supply water to the water heater 14 for producing hot water. The hot water flows from an outlet of the water heater 14 through a recirculation pump 16 to a dispensing head 18. The hot water is recirculated continuously from the dispensing head 18 to the water heater 14 via recirculation line 20 by the recirculation pump 16. A supply of beverage concentrate 22 is directed to the dispensing head 18 by a pump 24. The dispensing head 18 mixes the beverage concentrate and hot water to produce the hot beverage and discharges the hot beverage at an outlet 26 as needed. Water is continuously recirculated through a continuous loop from the water heater 14 through a recirculation chamber 19 of the dispensing head 18 and back to the water heater 14. A flow regulator 21 regulates the water flow through the dispensing head 18, as discussed in more detail below. It is understood that a fluid other than water can be used instead.

The water heater 14 desirably provides a continuous supply of hot water at a substantially uniform preset temperature, and is preferably compact in size. The water heater 14 typically employs one or more electric heating elements and is designed to avoid overheating. The heater 14 includes a temperature control or regulator that varies the power automatically and quickly in response to the measured temperature provided by one or more sensors to deliver hot water at a substantially constant temperature. The typical range of temperatures of the hot water is about 140–180° F., depending on the application. One type of water heater that is suitable for the present system 10 is an on-demand heater such as those sold under the trademark Seisco™. An on-demand heater saves space by providing a tankless unit. The water source 12 is coupled to the recirculation line 20 near the input to the water heater 14. If the hot water is not discharged by the dispensing head 18, the hot water recirculates through the water heater 14 and substantially no nonheated water from the water source 12 enters the water heater 14. The amount of nonheated water entering the heater 14 from the water source 12 depends on the rate of beverage delivery from the dispensing head 18. The water heater 14 heats the water quickly and, coupled with the recirculation of the hot water via the recirculation line 20, provides hot water at a desired temperature continuously and virtually instantaneously on-demand.

The recirculation pump 16 sets the flow rate of hot water from the water heater 14 to the dispensing head 18 and recirculates the water between the dispensing head 18 and the heater 14. A variety of pumps can be used, such as those available from Grundfos Pumps Corporation. The recirculation pump 16 preferably is substantially maintenance-free, and uses no more power than necessary to recirculate the hot water. In one example, the pump 16 has about 1/25 horsepower, about 30 Watts electrical power usage, and about 0.27 amps current draw. The pump 16 is selected to handle the high temperature of the hot water, typically in the range of about 140–180° F.

The pump 24 directs the beverage concentrate from the supply 22 to the dispensing head 18 at a preset flow rate. The beverage concentrate is typically a syrup concentrate for coffee, decaffeinated coffee, tea, hot chocolate or the like. The beverage concentrate supply 22 typically comes in a bag-in-box container. The pump 24 desirably pumps the concentrate, which can have a substantially higher viscosity than water, in a continuous manner while avoiding sticking, drying, coagulation or gumming of the concentrate. This is accomplished by using a pump such as a peristaltic pump which employs a closed system with tubings that substantially prevent introduction of air that might otherwise cause the concentrate to dry out and stick. Employing a rotary action, peristaltic pumps advantageously can slowly drive the concentrate at a flow rate that is proportional to the degree of rotation. The rate of rotation is variable and adjusted according to the concentration of the beverage concentrate. The rate of rotation is controlled by a speed control circuit card which is available, for instance, from Glasstender. Suitable peristaltic pumps include those sold under the registered trademark Beta Technologies, although other types of pumps may also be used.

Figure 2:
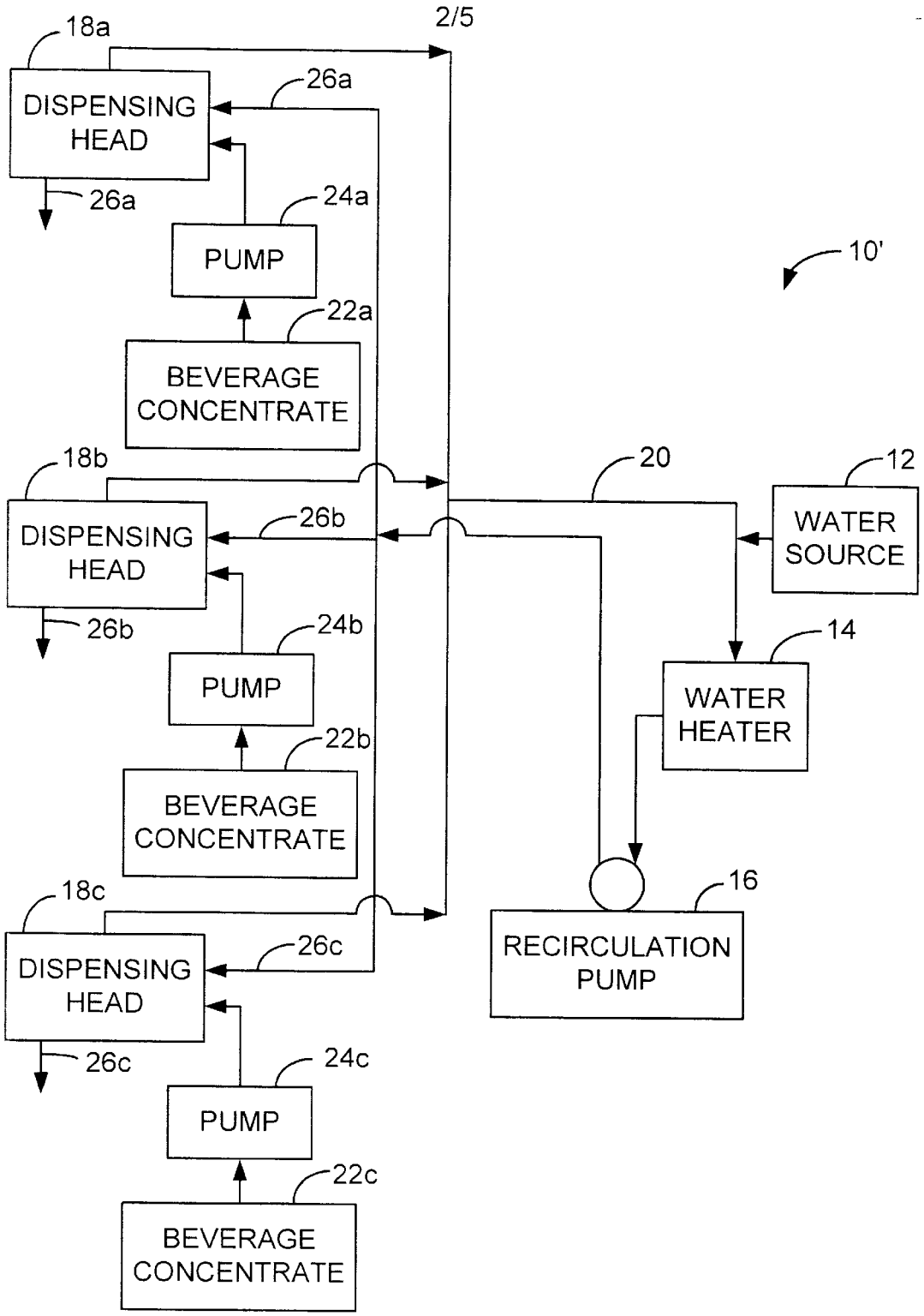
FIG. 2 is a block diagram schematically illustrating a dispensing system having multiple dispensing heads in accordance with another embodiment of the present invention.

It is possible for the dispensing system of the present invention to support additional beverage concentrate supplies for mixing and dispensing several beverages. In a multi-beverage system 10' as shown in FIG. 2, the hot water produced by the water heater 14 and driven by the recirculation pump 16 is split into three separate branches 26*a*, 26*b*, 26*c* having separate dispensing heads 18*a*, 18*b*, 18*c*, and recirculated through branches 28*a*, 28*b*, 28*c* to the recirculation line 20. Separate beverage concentrate sources 22*a*, 22*b*, 22*c* provide concentrates to the dispensing heads 18*a*, 18*b*, 18*c* via separate beverage concentrate pumps 24*a*, 24*b*, 24*c* to discharge hot beverages through outlets 26*a*, 26*b*, 26*c*. More or fewer branches are possible.

Figure 3:
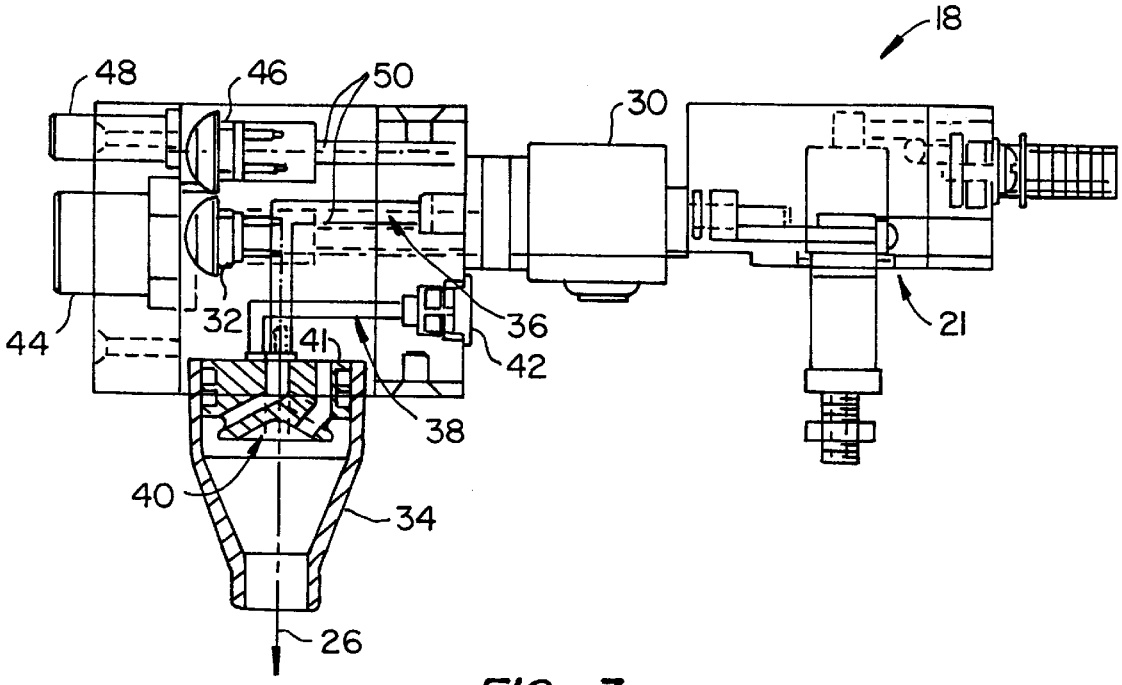
FIG. 3 is an elevational view of a dispensing head in the dispensing system of FIG. 1.

FIG. 3 illustrates an embodiment of the dispensing head 18, which includes a solenoid valve 30 and a pushbutton switch 32. The solenoid valve 30 is turned on and off by activation of the switch 32 to control the flow of hot water through the dispensing head 18. The pushbutton switch 32 also communicates with the beverage concentrate supply 22 to control the flow of concentrate from the beverage concentrate pump 24. The dispensing head 18 has a nozzle 34 with the outlet 26. The nozzle 34 is coupled to the solenoid valve 30 via a hot water line 36 for receiving the hot water and to the beverage concentrate supply 22 via a beverage concentrate line 38 for receiving the beverage concentrate. A beverage concentrate coupler 48 couples the beverage concentrate line 38 to the beverage concentrate source 22 and pump 24. A mixing diffuser 40 is coupled to the hot water line 36 and beverage concentrate line 38 for mixing the water and the concentrate. In one embodiment, the mixing diffuser 40 includes a plurality of spaced apertures arranged for spraying hot water from the hot water line 36 and concentrate from the beverage concentrate line 38 to create a vortex mixing action in the nozzle 34.

A button 44 is provided for activating the switch 32 to dispense a mixed beverage. It is understood that additional buttons and switches can be included for dispensing additional beverages with the dispensing head 18. A hot water switch 46 is operable with a pushbutton 48 for activating the solenoid valve 30 only for dispensing hot water through the nozzle 34. The switches 32, 46 control the solenoid valve 30 via electrical lines 50.

The flow regulator 21 is provided for regulating the flow through the dispensing head 18 and back to the recirculation line 20 (as shown in FIG. 1). Water is continuously recirculated through a continuous loop from the water heater 14 through the recirculation chamber 19 of the dispensing head 18 and back to the water heater 14. When the valve 30 in the dispensing head 18 opens, the water flows from the recirculation chamber 19 through the flow regulator 21 through the dispensing head 18 and out of the nozzle 34 through the outlet 26. The flow regulator 21 automatically compensates for variances in the water pressure and flow rate by delivering a consistent water output. Water pressure variances occur consistently as the hot water temperature varies due to the heater's thermostatic cycle. Water pressure is also affected by adjacent appliance or fixture water use.

When no hot water is discharged from the dispensing head 18, it is recirculated back to the water heater 14. When the dispensing head 18 discharges hot water into the hot water line 36 to the nozzle 34, the recirculation pump 16 generates sufficient flow to ensure that a portion of the hot water is recirculated through the recirculation line 20 back to the heater 14. The recirculation ensures a constant supply of hot water that is at a substantially constant preset temperature, so that hot water at the desired preset temperature is delivered substantially at the instant the solenoid valve 30 is activated to discharge the hot water. It is understood that the embodiment shown is for illustrative purposes only. Other suitable components for the dispensing head can be used in alternative embodiments.

The operation of the dispensing head 18 is as follows. When the mixed beverage button 44 is pushed against the switch 32, the switch 32 activates both the valve 30 and the beverage pump 24 for directing hot water and beverage concentrate, respectively, via the hot water line 36 and the beverage concentrate line 38, through the mixing diffuser 40 and nozzle 34 in which they are mixed, and out the nozzle outlet 26. Since the mixing of the hot water and beverage concentrate takes place after extraction and delivery of the ingredients to the dispensing head 18, the head 18 is referred to as a post-mix dispensing head 18.

In a preferred embodiment, the valve 30 may be opened slightly ahead of activation of the beverage concentrate pump 24 to flow hot water to the nozzle first. This advantageously cleans out any residual beverage concentrate that may have remained in the dispensing head 18 mixing region (i.e., mixing diffuser 40 and nozzle 34) from the previous pour. This feature is particularly desirable if multiple beverage concentrate supplies are provided in the system to avoid mixing in a different residual beverage concentrate. Furthermore, flowing the hot water to the mixing diffuser 40 first provides better mixing because hot water tends to swirl more readily than the concentrate, and will start the vortex-like mixing action just prior to injection of the beverage concentrate.

When the hot water enters the mixing region in the nozzle 34 from the hot water line 36 and the beverage concentrate from the beverage concentrate line 38, a vortex post-mix action of the concentrate and the hot water occurs. The vortex action results from the fluid pressure and flow velocity of the hot water as it mixes with the beverage concentrate delivered by the beverage concentrate pump 24 in very small quantities. The beverage concentrate can be ratio'd to a range anywhere from about 5:1 to about 120:1 ratio of water to concentrate. The very small quantities required of the very concentrated beverage concentrate provide for a very efficient and economical usage of the beverage product. An air vent 41 may be provided to the nozzle 34 to allow air intake to prevent siphon vacuum suction from occurring in the mixing region in the nozzle 34.

The temperature of the water heater 14, flow rate of the recirculation pump 16, and flow rate of the beverage concentrate pump 24 can be manually set individually.

Alternatively, a central automatic controller employing electronic hardware and software such as a personal computer (not shown) can be used to conveniently set and adjust these and any other parameters of the system from a central input device such as a keyboard.

Figure 4:
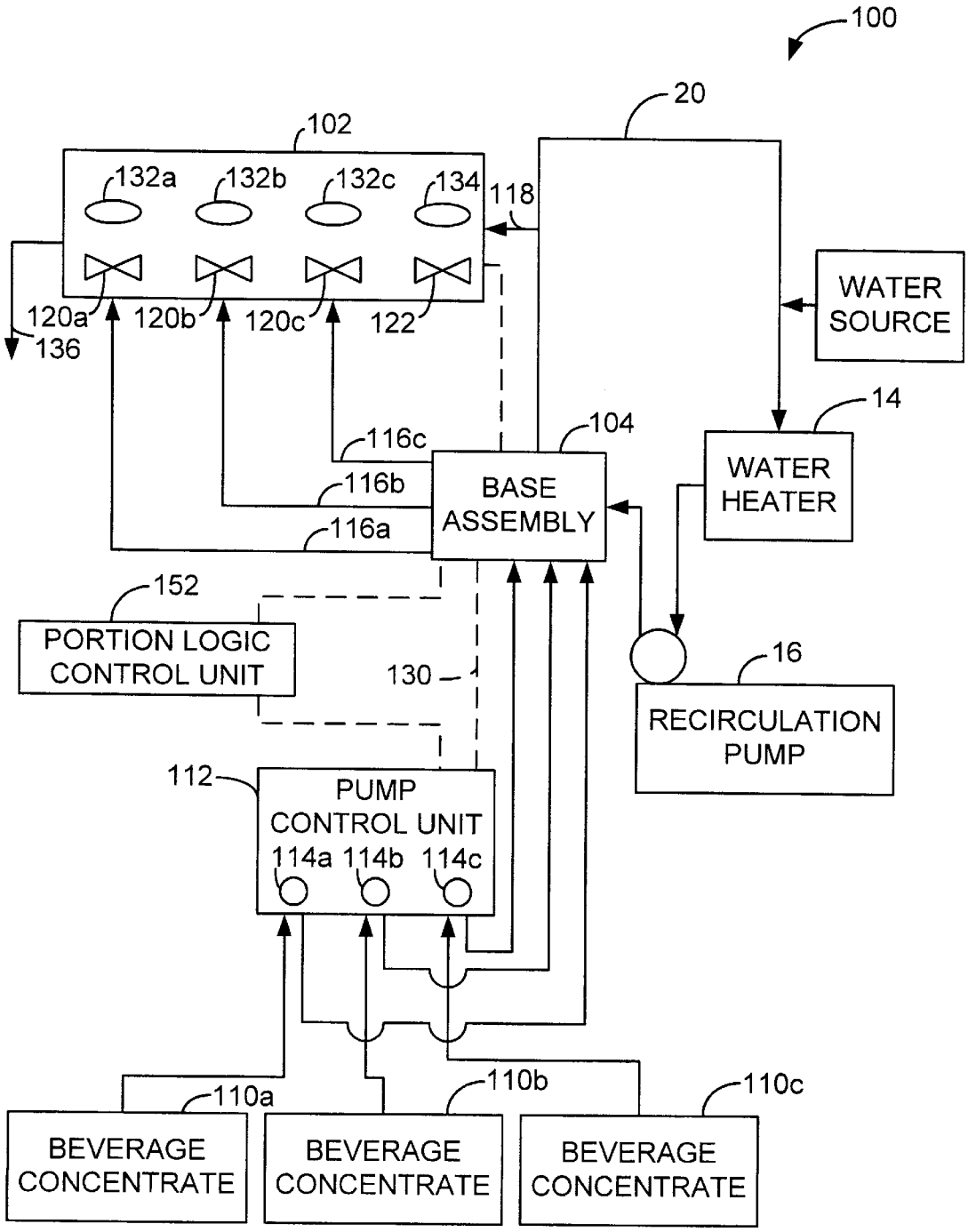
FIG. 4 is a block diagram schematically illustrating a dispensing system having a handheld flex-hose type dispensing head coupled with multiple beverage concentrate sources in accordance with another embodiment of the invention.

FIG. 4 shows another multi-beverage dispensing system 100 employing a single dispensing bead 102 for dispensing one of several beverages. This system 110 employs a hand-held flex-hose-type dispensing head. The hot water produced by the water heater 14 and driven by the recirculation pump 16 is directed to a base assembly 104 serving as a recirculation chamber and recirculated via the recirculation line 20.

Multiple beverage concentrate sources 110*a*, 110*b*, 110*c* provide several beverage concentrates. A pump control unit 112 includes control switches 114*a*, 114*b*, 114*c* which are operable to control pumping of each of the beverage concentrates from the sources 110*a*, 110*b*, 110*c* through the base assembly 104 to the dispensing head 102 via beverage concentrate lines 116*a*, 116*b*, 116*c*. The hot water flows from the base assembly 104 to the dispensing head 102 via hot water line 118. The dispensing head 102 includes beverage concentrate valves 120*a*, 120*b*, 120*c* for controlling the flow of the beverage concentrates from beverage concentrates lines 116*a*, 116*b*, 116*c*, and a water valve 122 for controlling the flow of the hot water from hot water line 118.

A control line 130 extends from the dispensing head 102 through the base assembly 104 to the pump control unit 112. The dispensing head 102 typically includes a plurality of buttons 132*a*, 132*b*, 132*c*. When one of the buttons (132*a*, 132*b*, or 132*c*) is pushed, a control signal is generated via the control line 130 to activate a corresponding control switch (114*a*, 114*b*, or 114*c*) to direct flow of beverage concentrate from the corresponding source (110*a*, 110*b*, or 110*c*) to the dispensing head 102. The corresponding valve (132*a*, 132*b*, or 132*c*) and the hot water valve 134 in the dispensing head 102 are opened to allow mixing of the beverage concentrate and the hot water and dispensing of the mixed beverage through the outlet 136. A water button 134 may be provided for opening the hot water valve 122 for dispensing hot water only. The water button 134 is not coupled to the pump control unit.

Figure 5:
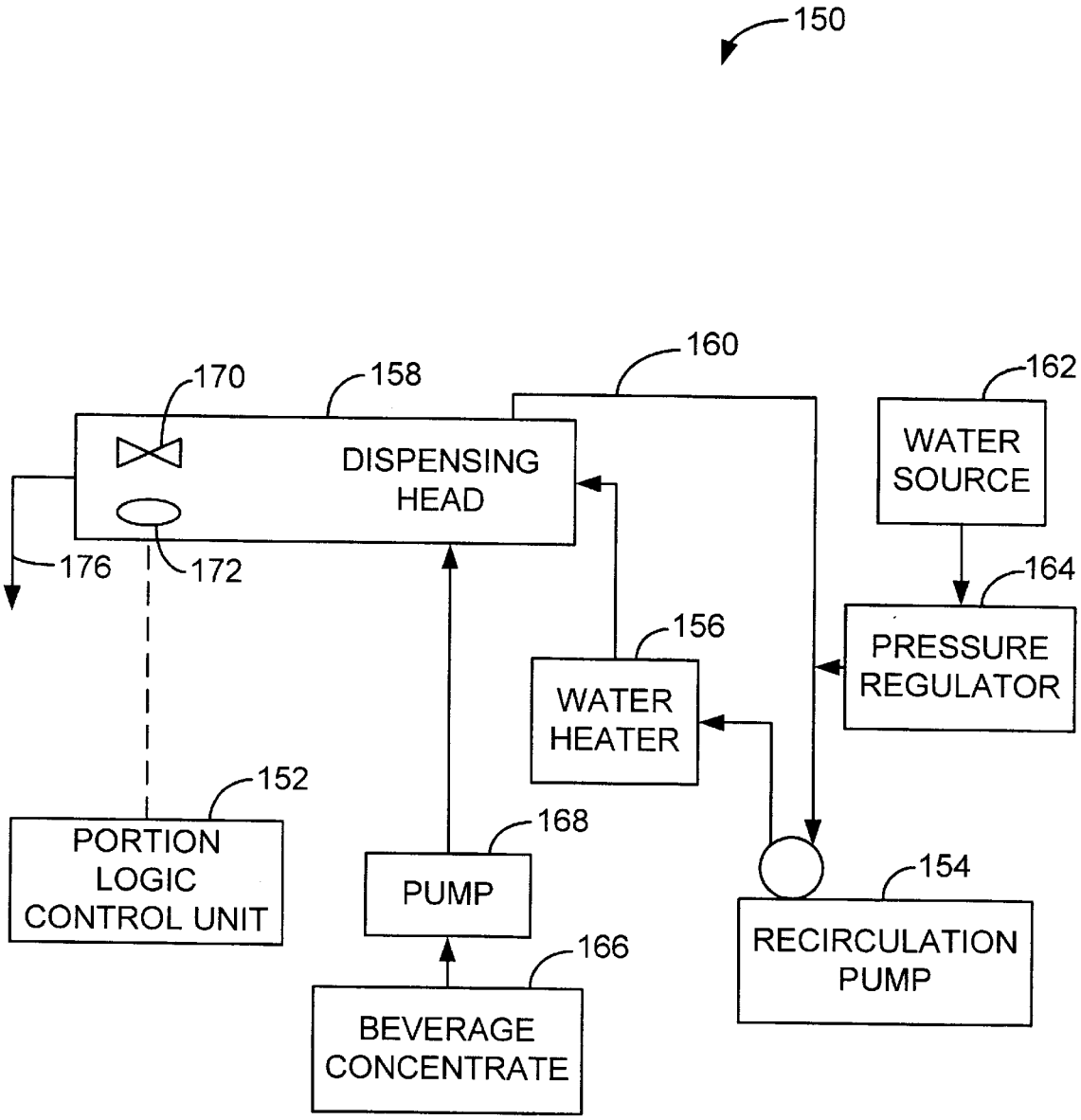
FIG. 5 is a block diagram schematically illustrating a dispensing system having a portion logic control unit in accordance with another embodiment of the invention.

FIG. 5 shows a beverage dispensing system 150 which employs a portion logic control (PLC) unit 152 to control the dispensing operation. The system 150 includes a recirculation pump 154 for recirculating water heated by the water heater 156 and directed to the dispensing head 158 back via the recirculation line 160. The water is supplied from the water source 162. A pressure regulator 164 is advantageously provided to set the pressure and the flow rate of the water supply to consistent levels. The beverage concentrate is flowed from the beverage concentrate source 166 to the dispensing head 158 by the pump 168.

The dispensing head 158 includes a valve 170 operable by a switch 172. In a specific embodiment, the switch 172 is an electronic operated solenoid valve. The switch 172 is coupled to the PLC unit 152 which is operable to deliver a timed pulse to the switch 172 to open the valve 170 for a predetermined period of time for dispensing mixed beverage through the outlet 176. The PLC unit 152 can be programmed to vary the pour time, typically between about 0.05 to about 999.05 seconds. This provides a wide range of hot beverage dispense portions ranging from a small cup to a large storage vessel for mass distribution. An example of a suitable PLC unit is a available from Siemens. Note that the PLC unit 152 can also be incorporated in another system to control the pour time, such as the system 100 shown in FIG. 4.

Figure 6:
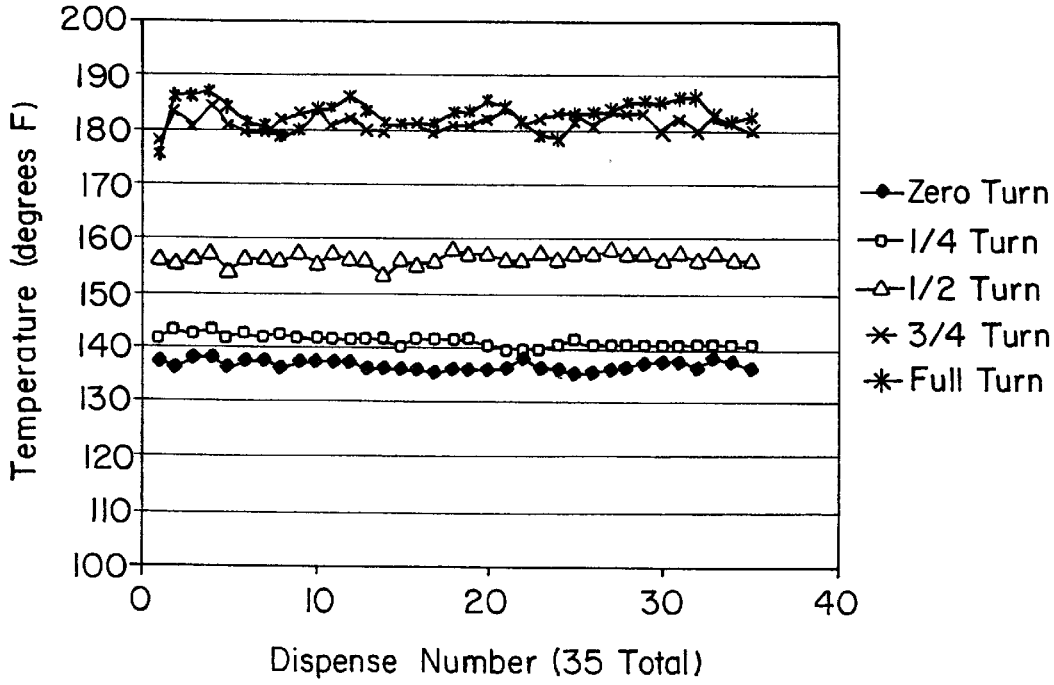
FIG. 6 is a diagram of beverage temperature versus dispense number using the dispensing system of the invention.

FIG. 6 shows the experimental results obtained by dispensing beverages using the system 100 of the invention. In the experiment, the water heater 14 contains two 2500 Watt heating elements and a new board having a high limit switch of over 200° F. The temperature range is adjusted using a potentiometer which provides a full turn with set points ranging from about 140° F. to about 180° F. FIG. 6 shows substantially consistent temperature with about 35 pours for each of the temperature settings.

In another experiment studying the long-term temperature range control, the conditions of the test are as follows:

temperature measurements nonstop for 3 minutes;

wait 1 minute and then dispense or pour beverage and measure temperature;

wait 5 minutes and then pour and measure temperature;

wait 10 minutes and then pour and measure temperature; and wait 30 minutes and then pour and measure temperature.

The results for long-term temperature range are as follows:

Long-Term Temperature Range

| Time | Temperature |
|---|---|
| Wait one minute | 173° F. |
| Wait 5 minutes | 173° F. |
| Wait 10 minutes | 173° F. |
| Wait 30 minutes | 173° F. |

With the temperature potentiometer setting at 173° F., the long term temperature range results show no noticeable deviation from the initial temperature of 173° F.

Employing a hot water recirculation arrangement with an on-demand water heater 14 and a post-mix dispensing head 18 that discharges hot water slightly ahead of beverage concentrate, the present invention provides a system for economically dispensing hot beverages at precise temperature ranges in a continuous manner suitable for large-scale high-volume usage.

The principles, preferred embodiments and modes of operation of the present invention have been described in the foregoing specification. However, the invention which is intended to be protected is not to be construed as limited to the particular embodiments disclosed. The embodiments are to be construed as illustrative rather than restrictive. Variations and changes may be made by others without departing from the spirit of the present invention. Accordingly, all such variations and changes which fall within the spirit and scope of the present invention as defined in the following claims are expressly intended to be embraced thereby.

What is claimed is:

1. A system for dispensing hot beverages comprising:

a water heater for producing hot water;

a water pump coupled downstream of the water heater;

a dispensing device coupled downstream of the water pump;

a recirculation line coupled between the dispensing device and the water heater;

a source of beverage concentrate; and a beverage concentrate pump coupled between the beverage concentrate source and the dispensing device.

2. The system of claim 1 wherein the water heater is an on-demand, tankless water heater.

3. The system of claim 1 wherein the water heater heats water to a temperature of about 140–180° F.

4. The system of claim 1 wherein the beverage concentrate pump comprises a peristaltic pump.

5. The system of claim 1 wherein the dispensing device comprises a dispensing head having a nozzle for mixing the hot water and beverage concentrate, a valve movable between a closed position for blocking a flow of the hot water to the nozzle and an open position for allowing the flow of the hot water to the nozzle, and a switch activatable to move the valve between the closed position and the open position.

6. The system of claim 5 wherein the switch is coupled with the beverage concentrate pump for activating the beverage concentrate pump to flow beverage concentrate to the nozzle generally simultaneously with the flow of hot water to the nozzle and to terminate flow of the beverage concentrate to the nozzle generally simultaneously with the termination of the flow of hot water to the nozzle.

7. The system of claim 6 wherein the switch is configured to move the valve to the open position to flow the hot water into the nozzle slightly before activating the beverage concentrate pump to flow the beverage concentrate to the nozzle.

8. The system of claim 5 further comprising a flow regulator coupled with the dispensing head to regulate the flow of the hot water from the water heater through a recirculation chamber of the dispensing head and to the recirculation line.

9. The system of claim 5 wherein the nozzle is coupleable to an air vent to prevent siphon vacuum suction in the nozzle.

10. The system of claim 1 wherein the beverage concentrate is brixed in the nozzle to a range of about 5:1 to about 120:1 ratio of water to concentrate.

11. The system of claim 1 including a plurality of sources of beverage concentrates and corresponding beverage concentrate pumps coupled between the beverage concentrate sources and the dispensing device.

12. The system of claim 11 wherein the dispensing device comprises a plurality of dispensing heads each coupled with one of the plurality of beverage concentrate pumps for receiving beverage concentrate from one of the plurality of beverage concentrate sources.

13. The system of claim 11 wherein the dispensing device comprises a dispensing head coupled with the beverage concentrate pumps via a plurality of beverage concentrate lines, and a control device operable for selectively activating the beverage concentrate pumps for pumping the beverage concentrates to the dispensing head.

14. The system of claim 13 wherein the dispensing head includes a plurality of valves each coupled with a corresponding beverage concentrate line, the valves being operable to open selectively to allow beverage concentrate to flow from the activated beverage concentrate pump through the corresponding beverage concentrate line out of the corresponding valve.

15. The system of claim 13 wherein the dispensing head includes a water valve coupled with the recirculation line, the water valve being operable to open selectively in a mixing mode for mixing with the beverage concentrate flowed from the activated beverage concentrate pump to the dispensing head and in a nonmixing mode for flowing water from the recirculation line out through the dispensing head.

16. The system of claim 1 wherein the dispensing device includes a valve; a switch operable to control opening and closing of the valve; and a control unit operable to activate the switch to open the valve for a selected period of time for dispensing.

17. A system for dispensing hot beverages comprising:

means for heating a fluid;

a fluid pump coupled downstream of the heating means;

a dispensing device coupled downstream of the fluid pump;

a recirculation line coupled between the dispensing device and the heating means; and means for supplying at least one source of beverage concentrate to the dispensing device.

18. The system of claim 17 wherein the dispensing device comprises at least one dispensing head each having a nozzle for mixing the heated fluid from the heating means and beverage concentrate, fluid flow means movable between a closed position for blocking a flow of the heated fluid to the nozzle and an open position for allowing the flow of the heated fluid to the nozzle, and beverage concentrate flow means movable between a closed position for blocking a flow of the beverage concentrate to the nozzle and an open position for allowing the flow of the beverage concentrate to the nozzle.

19. The system of claim 18 wherein the nozzle includes an air vent.

20. The system of claim 17 further comprising means for sensing a temperature of the fluid and adjusting the heating means to heat the fluid substantially to a preset temperature.

21. The system of claim 17 further comprising means for controlling the dispensing device to dispense for a selected period of time.

22. A method of dispensing a hot beverage from a dispensing device upon activation of a switch comprising the steps of:

heating water substantially to a preset temperature;

flowing the heated water into the dispensing device upon activation of the switch to form a vortex-like flow in the dispensing device; and flowing a beverage concentrate into the vortex-like flow of the heated water to mix the beverage concentrate with the heated water in the dispensing device to form the hot beverage and discharge the hot beverage out of the dispensing device.

23. The method of claim 22 wherein the step of flowing the beverage concentrate comprises substantially preventing air from entering the flow of the beverage concentrate to avoid drying the beverage concentrate.

24. The method of claim 22 further comprising the step of venting the dispensing device to prevent siphon vacuum suction during mixing of the beverage concentrate and the heated water.

25. The method of claim 22 further comprising the steps of recirculating the heated water through the dispensing device out, heating the recirculated water, and directing the recirculated water back to the dispensing device to provide a continuous flow of the heated water to the dispensing device.

* * * * *